US009117382B2

(12) United States Patent
Boelter et al.

(10) Patent No.: US 9,117,382 B2
(45) Date of Patent: Aug. 25, 2015

(54) DEVICE AND METHOD FOR AUTOMATIC VIEWING PERSPECTIVE CORRECTION

(71) Applicant: Intel Corporation, Santa Clara, CA (US)

(72) Inventors: Joshua Boelter, Portland, OR (US); Don G. Meyers, Rescue, CA (US); David Stanasolovich, Albuquerque, NM (US); Sudip S. Chahal, Gold River, CA (US)

(73) Assignee: Intel Corporation, Santa Clara, CA (US)

( * ) Notice: Subject to any disclaimer, the term of this patent is extended or adjusted under 35 U.S.C. 154(b) by 181 days.

(21) Appl. No.: 13/631,469

(22) Filed: Sep. 28, 2012

(65) Prior Publication Data

US 2014/0092142 A1 Apr. 3, 2014

(51) Int. Cl.
*G09G 5/00* (2006.01)

(52) U.S. Cl.
CPC ..... *G09G 5/00* (2013.01); *G09G 2320/028* (2013.01); *G09G 2354/00* (2013.01)

(58) Field of Classification Search
USPC ..... 345/647
See application file for complete search history.

(56) References Cited

U.S. PATENT DOCUMENTS

| | | | | |
|---|---|---|---|---|
| 5,303,337 | A * | 4/1994 | Ishida | 345/419 |
| 5,796,426 | A * | 8/1998 | Gullichsen et al. | 348/207.99 |
| 6,271,875 | B1 | 8/2001 | Shimizu et al. | |
| 6,628,283 | B1 | 9/2003 | Gardner | |
| 6,877,863 | B2 * | 4/2005 | Wood et al. | 353/70 |
| 7,042,497 | B2 * | 5/2006 | Gullichsen et al. | 348/207.99 |
| 7,873,233 | B2 * | 1/2011 | Kadantseva et al. | 382/275 |
| 8,285,077 | B2 * | 10/2012 | Fero et al. | 382/290 |
| 8,417,057 | B2 * | 4/2013 | Oh et al. | 382/275 |
| 8,885,972 | B2 * | 11/2014 | Kacher et al. | 382/275 |
| 2002/0149808 | A1 * | 10/2002 | Pilu | 358/530 |
| 2007/0052708 | A1 | 3/2007 | Won et al. | |

(Continued)

FOREIGN PATENT DOCUMENTS

| | | | |
|---|---|---|---|
| KR | 100908123 | B1 | 7/2009 |
| KR | 1020100030749 | A | 3/2010 |
| WO | 2013138632 | A1 | 9/2013 |

OTHER PUBLICATIONS

"Eye tracking," Wikipedia, The Free Encyclopedia, retrieved from: <http://en.wikipedia.org/w/index.php?title=Eye_tracking&oldid=486865540>, edited Apr. 11, 2012, 7 pages.

Viola et al., "Rapid Object Detection Using a Booted Cascade of Simple Features", Accepted Conference on Computer Vision and Pattern Recognition, 2001, 9 pages.

(Continued)

*Primary Examiner* — M Good Johnson
(74) *Attorney, Agent, or Firm* — Barnes & Thornburg LLP

(57) ABSTRACT

Devices and methods for improving viewing perspective of content displayed on the display screen of a computing device include determining one or more viewing angles relative to a viewer of the content, generating a content transformation to apply a corrective distortion to the content to improve the viewing perspective when viewed at the one or more viewing angles, and rendering the content as a function of the content transformation. The viewing angles relative to a viewer of the content may be determined automatically using viewer location sensors, or may be input manually by the viewer. The content transformation visually scales the content by an appropriate factor to compensate for visual distortion experienced by the viewer at one or more viewing angles. Content may be transformed as a function of a single approximate viewing angle or multiple viewing angles.

24 Claims, 3 Drawing Sheets

(56) References Cited

U.S. PATENT DOCUMENTS

| | | | | |
|---|---|---|---|---|
| 2008/0309660 | A1* | 12/2008 | Bertolami et al. | 345/419 |
| 2010/0064259 | A1 | 3/2010 | Alexanderovitc et al. | |
| 2011/0279446 | A1* | 11/2011 | Castro et al. | 345/419 |
| 2013/0044124 | A1* | 2/2013 | Reichert, Jr. | 345/618 |

OTHER PUBLICATIONS

U.S. Appl. No. 13/631,519, filed Sep. 28, 2012, 31 pages.

International Search Report and Written Opinion received for PCT Application No. PCT/US2013/062408, mailed on Jan. 28, 2014, 15 pages.

* cited by examiner

DEVICE AND METHOD FOR AUTOMATIC VIEWING PERSPECTIVE CORRECTION

BACKGROUND

Computing devices generally display two-dimensional user interfaces using displays with two-dimensional display screens. When such two-dimensional displays are viewed from any angle other than perpendicular to the display screen, the viewer may experience visual distortion from the change in perspective. However, certain classes of computing devices are often viewed from angles other than perpendicular to the display screen. For example, tablet computers are often used while resting flat on a table top surface. Similarly, some computing devices embed their display in the top surface of a table-like device (e.g., the Microsoft® PixelSense™).

Several available technologies are capable of tracking the location of a user's head or eyes. A camera with appropriate software may be capable of discerning a user's head or eyes. More sophisticated sensors may supplement the camera with depth sensing hardware to detect the location of the user in three dimensions. Dedicated eye-tracking sensors also exist, which can provide information on the location of a user's eyes and the direction of the user's gaze.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

DETAILED DESCRIPTION OF THE DRAWINGS

Figure 1:
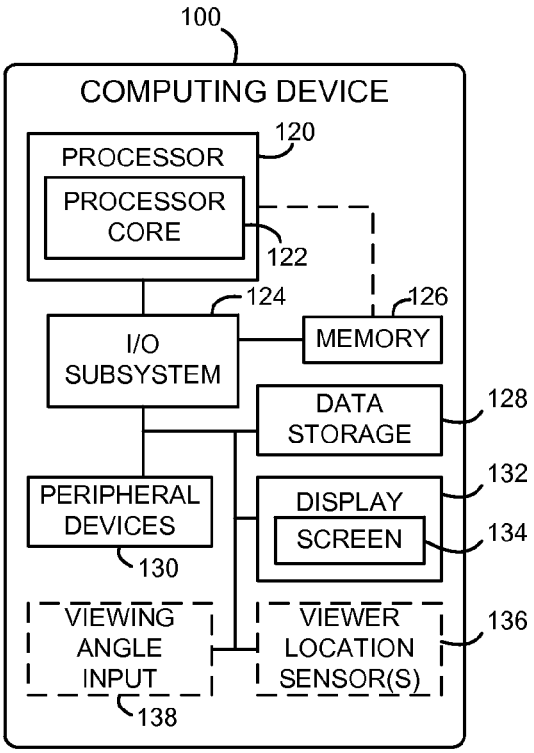
FIG. 1 is a simplified block diagram of at least one embodiment of a computing device to improve viewing perspective of displayed content.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

The disclosed embodiments may be implemented, in some cases, in hardware, firmware, software, or any combination thereof. The disclosed embodiments may also be implemented as instructions carried by or stored on a transitory or non-transitory machine-readable (e.g., computer-readable) storage medium, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

Referring now to FIG. 1, in one embodiment, a computing device 100 is configured to improve viewing perspective of content displayed on a display 132 of the computing device 100 based on the location of a viewer of the display 132. To do so, as discussed in more detail below, the computing device 100 is configured to determine one or more viewing angles relative to the viewer of the content and automatically, or responsively, modify the viewing perspective of the content based on the one or more viewing angles. In the illustrative embodiments, the computing device 100 generates a content transformation to apply a corrective distortion to the content to improve the viewing perspective of the content as a function of one or more viewing angles.

By applying such corrective distortion to the content to improve the viewing perspective of the content for a viewing angle relative to the viewer, the computing device 100 allows the viewer to view the display 132 of the computing device 100 from any desired position while maintaining the viewing perspective of the displayed content similar to the viewing perspective when viewing the content perpendicular to the display 132. For example, the viewer may rest the computing device 100 flat on a table top and use the computing device 100 from a comfortable seating position, without significant visual distortion, and without leaning over the computing device 100.

The computing device 100 may be embodied as any type of computing device having a display, or coupled to a display, and capable of performing the functions described herein. For example, the computing device 100 may be embodied as, without limitation, a tablet computer, a table-top computer, a notebook computer, a desktop computer, a personal computer (PC), a laptop computer, a mobile computing device, a smart phone, a cellular telephone, a handset, a messaging device, a work station, a network appliance, a web appliance, a distributed computing system, a multiprocessor system, a processor-based system, a consumer electronic device, a digital television device, a set-top box, and/or any other computing device configured to determine one or more viewing angles for a viewer of the content and improve the viewing perspective of the content based on the one or more viewing angles.

In the illustrative embodiment of FIG. 1, the computing device 100 includes a processor 120, an I/O subsystem 124, a memory 126, a data storage 128, and one or more peripheral devices 130. In some embodiments, several of the foregoing components may be incorporated on a motherboard or main board of the computing device 100, while other components may be communicatively coupled to the motherboard via, for example, a peripheral port. Furthermore, it should be appreciated that the computing device 100 may include other components, sub-components, and devices commonly found in a computer and/or computing device, which are not illustrated in FIG. 1 for clarity of the description.

The processor 120 of the computing device 100 may be embodied as any type of processor capable of executing software/firmware, such as a microprocessor, digital signal processor, microcontroller, or the like. The processor 120 is illustratively embodied as a single core processor having a processor core 122. However, in other embodiments, the processor 120 may be embodied as a multi-core processor having multiple processor cores 122. Additionally, the computing device 100 may include additional processors 120 having one or more processor cores 122.

The I/O subsystem 124 of the computing device 100 may be embodied as circuitry and/or components to facilitate input/output operations with the processor 120 and/or other components of the computing device 100. In some embodiments, the I/O subsystem 124 may be embodied as a memory controller hub (MCH or "northbridge"), an input/output controller hub (ICH or "southbridge"), and a firmware device. In such embodiments, the firmware device of the I/O subsystem 124 may be embodied as a memory device for storing Basic Input/Output System (BIOS) data and/or instructions and/or other information (e.g., a BIOS driver used during booting of the computing device 100). However, in other embodiments, I/O subsystems having other configurations may be used. For example, in some embodiments, the I/O subsystem 124 may be embodied as a platform controller hub (PCH). In such embodiments, the memory controller hub (MCH) may be incorporated in or otherwise associated with the processor 120, and the processor 120 may communicate directly with the memory 126 (as shown by the hashed line in FIG. 1). Additionally, in other embodiments, the I/O subsystem 124 may form a portion of a system-on-a-chip (SoC) and be incorporated, along with the processor 120 and other components of the computing device 100, on a single integrated circuit chip.

The processor 120 is communicatively coupled to the I/O subsystem 124 via a number of signal paths. These signal paths (and other signal paths illustrated in FIG. 1) may be embodied as any type of signal paths capable of facilitating communication between the components of the computing device 100. For example, the signal paths may be embodied as any number of point-to-point links, wires, cables, light guides, printed circuit board traces, vias, bus, intervening devices, and/or the like.

The memory 126 of the computing device 100 may be embodied as or otherwise include one or more memory devices or data storage locations including, for example, dynamic random access memory devices (DRAM), synchronous dynamic random access memory devices (SDRAM), double-data rate synchronous dynamic random access memory device (DDR SDRAM), mask read-only memory (ROM) devices, erasable programmable ROM (EPROM), electrically erasable programmable ROM (EEPROM) devices, flash memory devices, and/or other volatile and/or non-volatile memory devices. The memory 126 is communicatively coupled to the I/O subsystem 124 via a number of signal paths. Although only a single memory device 126 is illustrated in FIG. 1, the computing device 100 may include additional memory devices in other embodiments. Various data and software may be stored in the memory 126. For example, one or more operating systems, applications, programs, libraries, and drivers that make up the software stack executed by the processor 120 may reside in memory 126 during execution.

The data storage 128 may be embodied as any type of device or devices configured for the short-term or long-term storage of data. For example, the data storage 128 may include any one or more memory devices and circuits, memory cards, hard disk drives, solid-state drives, or other data storage devices.

In some embodiments, the computing device 100 may also include one or more peripheral devices 130. Such peripheral devices 130 may include any number of additional input/output devices, interface devices, and/or other peripheral devices. For example, in some embodiments, the peripheral devices 130 may include a display, touch screen, graphics circuitry, keyboard, mouse, speaker system, and/or other input/output devices, interface devices, and/or peripheral devices.

In the illustrative embodiment, the computing device 100 also includes a display 132 and, in some embodiments, may include viewer location sensor(s) 136 and a viewing angle input 138. The display 132 of the computing device 100 may be embodied as any type of display capable of displaying digital information such as a liquid crystal display (LCD), a light emitting diode (LED), a plasma display, a cathode ray tube (CRT), or other type of display device. Regardless of the particular type of display, the display 132 includes a display screen 134 on which the content is displayed. In some embodiments, the display screen 134 may be embodied as a touch screen to facilitate user interaction.

The viewer location sensor(s) 136 may be embodied as any one or more sensors capable of determining the location of the viewer's head and/or eyes, such as a digital camera, a digital camera coupled with an infrared depth sensor, or an eye tracking sensor. For example, the viewer location sensor(s) 136 may be embodied as a wide-angle, low-resolution sensor such as a commodity digital camera capable of determining the location of the viewer's head. Alternatively, the viewer location sensor(s) 136 may be embodied as a more precise sensor, for example, an eye tracking sensor. The viewer location sensor(s) 136 may determine only the direction from the computing device 100 to the viewer's head and/or eyes, and are not required to determine the distance to the viewer.

The viewing angle input 138 may be embodied as any control capable of allowing the viewer to manually adjust the desired viewing angle, such as a hardware wheel, hardware control stick, hardware buttons, or a software control such as a graphical slider. In embodiments including the viewing angle input 138, the computing device 100 may or may not include the view location sensor(s) 136.

Figure 2:
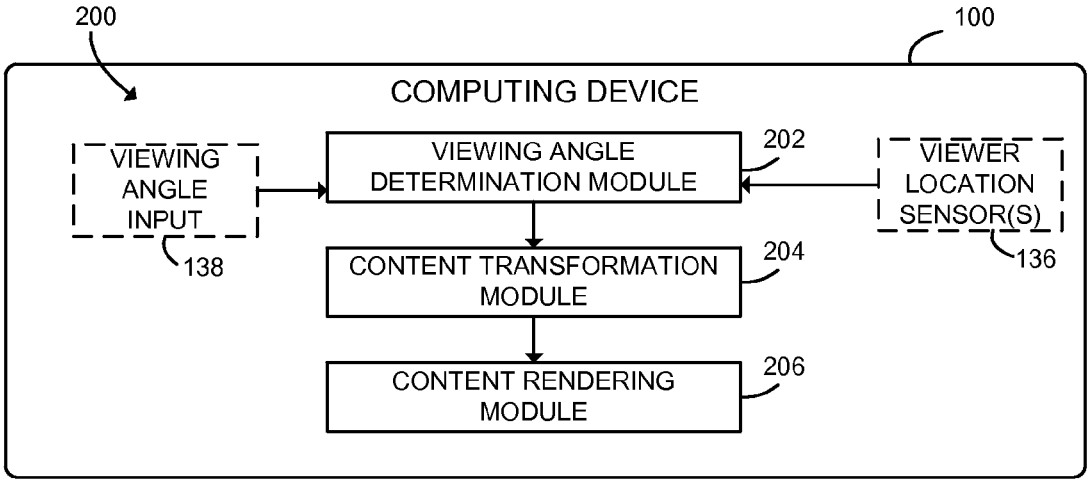
FIG. 2 is a simplified block diagram of at least one embodiment of an environment of the computing device of FIG. 1.

Referring now to FIG. 2, in one embodiment, the computing device 100 establishes an environment 200 during operation. The illustrative embodiment 200 includes a viewing angle determination module 202, a content transformation module 204, and a content rendering module 206. Each of the viewing angle determination module 202, the content transformation module 204, and the content rendering module 206 may be embodied as hardware, firmware, software, or a combination thereof.

The viewing angle determination module 202 is configured to determine one or more viewing angles of the content relative to a viewer of the content. In some embodiments, the viewing angle determination module 202 may receive data from the viewing location sensor(s) 136 and determine the viewing angle(s) based on the received data. Alternatively or additionally, the viewing angle determination module 202 may receive viewing angle input data from the viewing angle input 138 and determine the viewing angle(s) based on the viewing angle input data. For example, in some embodiments, the viewing angle input data received from the viewing angle input 138 may override, or otherwise have a higher priority than, the data received from the viewer location sensor(s) 136. Once determined, the viewing angle determination module 202 supplies the determined one or more viewing angles to the content transformation module 204.

The content transformation module 204 generates a content transformation for each of the one or more viewing angles determined by the viewing angle determination module 202 as a function of the one or more viewing angles. The content transformation is useable to apply a corrective distortion to the content, to improve the viewing perspective of the content when viewed at the one or more viewing angles. The content transformation may be embodied as any type of transformation that may be applied to the content. For example, in some embodiments, the content transformation may be embodied as an equation, an algorithm, a raw number, a percentage value, or other number or metric that defines, for example, the magnitude to which the content, or portion thereof, is stretched, cropped, compressed, duplicated, or otherwise modified. The generated content transformation is used by the content rendering module 206.

The content rendering module 206 renders the content as a function of the content transformation generated by the content transformation module 204. The rendered content may be generated by an operating system of the computing device 100, generated by one or more user applications executed on the computing device 100, or embodied as content (e.g., pictures, text, or video) stored on the computing device 100. For example, in some embodiments, the rendered content may be generated by, or otherwise in, a graphical browser such as a web browser executed on the computing device 100. The content may be embodied as content stored in a hypertext markup language (HTML) format for structuring and presenting content, such as HTML5 or earlier versions of HTML. The rendered content is displayed on the display screen 134 of the display 132.

Figure 3:
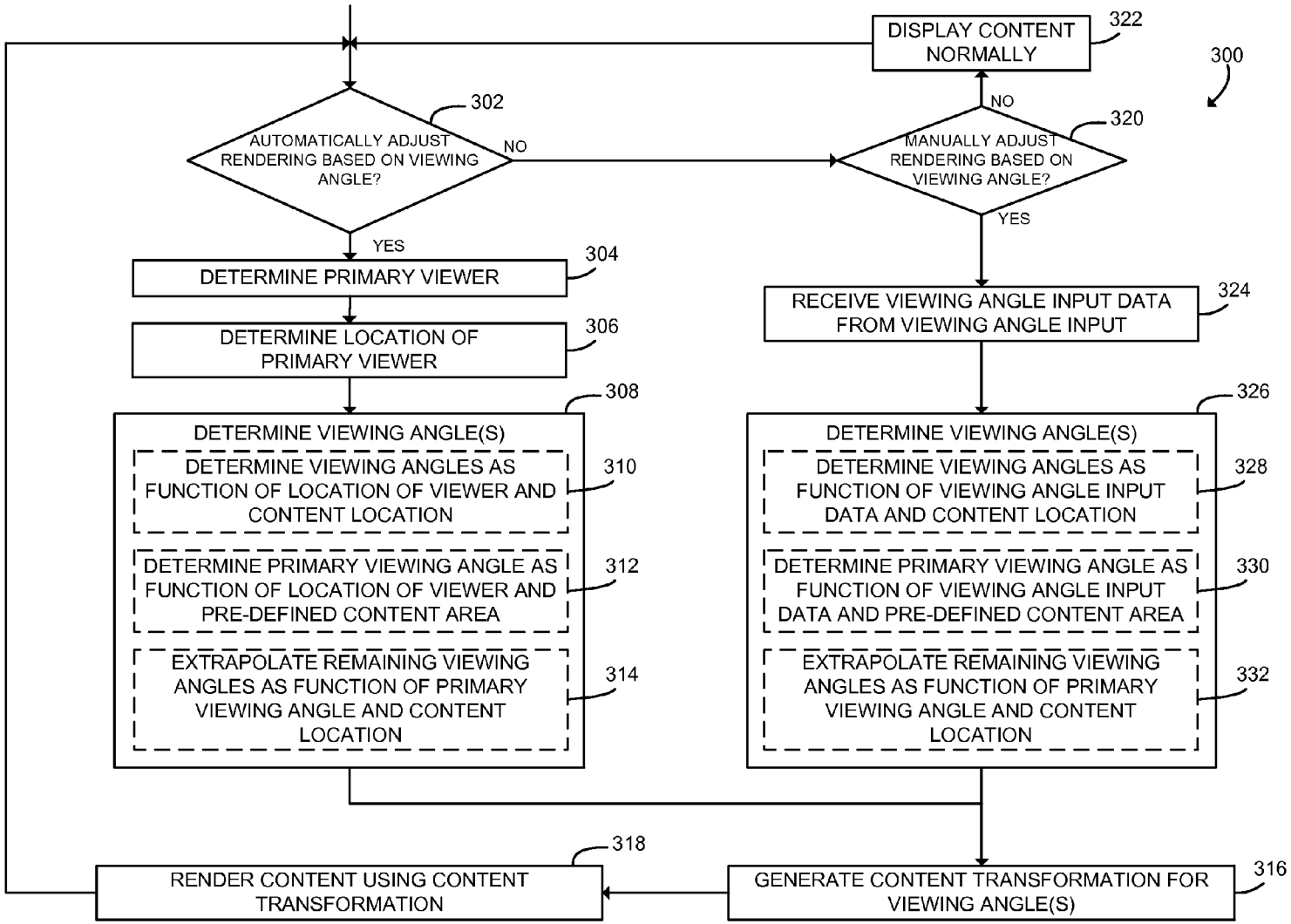
FIG. 3 is a simplified flow diagram of at least one embodiment of a method for improving viewing perspective of display content, which may be executed by the computing device of FIGS. 1 and 2.

Referring now to FIG. 3, in use, the computing device 100 may execute a method 300 for improving viewing perspective of content displayed on the computing device 100. The method 300 begins with block 302, in which the computing device 100 determines whether to automatically adjust rendering based on a content viewing angle(s) of a viewer. Such determination may be made in use, may be pre-configured, or may be dependent on whether the computing device 100 includes viewer location sensor(s) 136. Upon determining to automatically adjust rendering based on viewing angle, the method 300 advances to block 304.

In block 304, the viewing angle determination module 202 determines a primary viewer of the content. To do so, the viewing angle determination module 202 utilizes the viewer location sensor(s) 136. When only one viewer is present, the primary viewer is simply the sole viewer. However, when two or more viewers are present, the viewing angle determination module 202 may be configured to determine or select one of the viewers as the primary viewer for which the viewing perspective of the content is improved. For example, the viewing angle determination module 202 may determine the primary viewer by detecting which viewer is actively interacting with the computing device 100, by selecting the most proximate viewer to the display screen 134, randomly determining the primary viewer from the pool of detected viewers, based on pre-defined criteria or input supplied to the computing device 100, or by any other suitable technique.

In block 306, the viewing angle determination module 202 determines the location of the primary viewer relative to the display screen 134 of the display 132. To do so, the viewing angle determination module 202 uses the sensor signals received from viewer location sensor(s) 136 and determines the location of the primary viewer based on such sensor signals. In the illustrative embodiment, the viewing angle determination module 202 determines the location of the primary viewer by determining the location of the viewer's head and/or eyes. However, the precise location of the viewer's eyes is not required in all embodiments. Any suitable location determination algorithm or technique may be used to determine the location of the primary viewer relative to the display screen 134. In some embodiments, the location of the viewer is determined only in one dimension (e.g., left-to-right relative to the display screen 134). In other embodiments, the location of the viewer may be determined in two dimensions (e.g., left-to-right and top-to-bottom relative to the display screen 134). Further, in some embodiments, the location of the viewer may be determined in three dimensions (e.g., left-to-right, top-to-bottom, and distance from the display screen 134).

Figure 4:
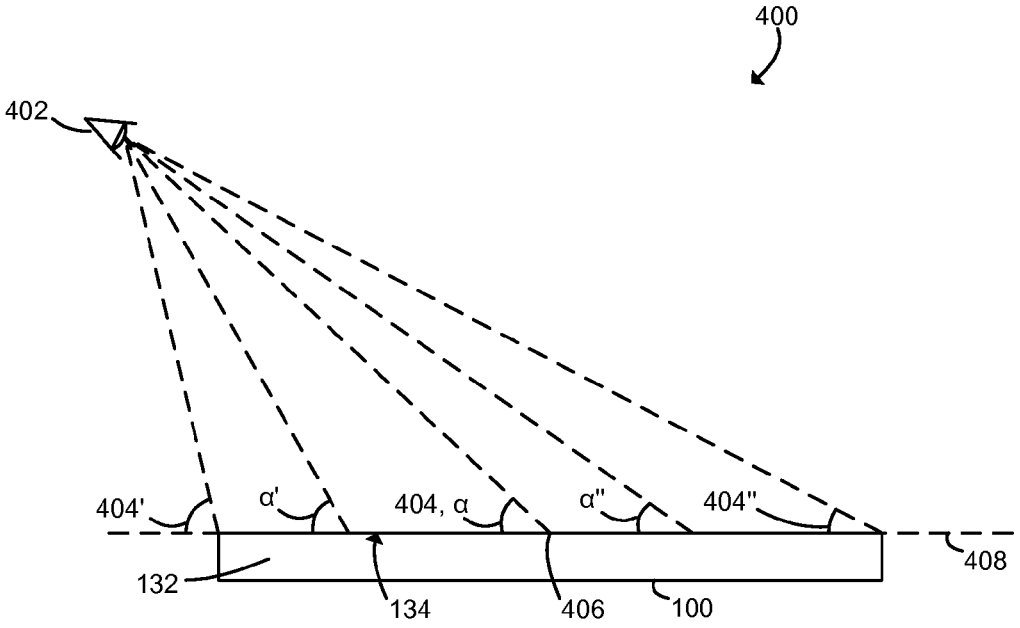
FIG. 4 is a schematic diagram representing the viewing angles of a viewer of the computing device of FIGS. 1 and 2.

In block 308, the viewing angle determination module 202 determines one or more viewing angles of the content relative to the viewer. For example, referring to FIG. 4, a schematic diagram 400 illustrates one or more viewing angles of content displayed on the display screen 134 of the display 132. An eye symbol 402 represents the location of the viewer relative to the display screen 134. A dashed line 408 may represent a plane defined by the display screen 134. As shown in FIG. 4, several viewing angles may be defined between the viewer 402 and the display screen 134 based on the particular content location. For example, an illustrative viewing angle 404 (also labeled $\alpha$) represents the viewing angle between the location of the viewer 402 and a center 406 of the display screen 134 of the display 132 of the computing device 100. That is, the viewing angle 404 is defined by the location of the viewer 402 and the location of the particular content on the display screen 134. Additionally, an illustrative angle 404' represents the viewing angle between the location of the viewer 402 and an edge location of the display screen 134 of the display 132 closest to the viewer. Illustrative angle $\alpha'$ represents the viewing angle between a location on the display screen 134 of the display 132 nearer to the user than the center 406. Further, an illustrative angle 404" represents the angle between the location of the viewer 402 and an edge of the display screen 134 of the display 132 farthest away from the viewer 402. Illustrative angle $\alpha''$ represents the viewing angle between a location on the display screen 134 of the display 132 farther away from the user than the center 406. In the illustrative embodiment of FIG. 4, each of the angles $\alpha$, $\alpha'$, and $\alpha''$ have a magnitude different from each other. However, as discussed in more detail below, the angles $\alpha$, $\alpha'$, and $\alpha''$ may be assumed to be approximately equal to each other (e.g., to the centrally located angle $\alpha$) in some embodiments.

Referring back to FIG. 3, the viewing angle determination module 202 may determine the one or more viewing angles of the content using any one or more techniques. For example, in some embodiments, the viewing angle determination module 202 determines a viewing angle for each content location on the display screen 134 of the display 132 in block 310. In some embodiments, each content location may correspond to a single physical pixel on the display screen 134. Alternatively, in other embodiments, each content location may correspond to a group of physical pixels on the display screen 134. For example, the content location may be embodied as a horizontal stripe of pixels. As discussed above with regard to FIG. 4, the angle from the viewer 402 to each content location on the display 132 may have a slightly different magnitude, and the viewing angle determination module 202 may determine the magnitude of each angle accordingly.

Alternatively, in some embodiments, the viewing angle determination module 202 may determine only a single, primary viewing angle as a function of the location of the viewer and a pre-defined content location on the display screen 134 of the display 132 in block 312. In some embodiments, the pre-defined content location is selected to be located at or near the center of the display screen 134 of the display 132. For example, as shown in FIG. 4, the angle $\alpha$ may represent the primary viewing angle. In some embodiments, the primary viewing angle $\alpha$ is used as an approximate for the viewing angles to other content locations, for example, angles $\alpha'$ and $\alpha''$. Of course, in other embodiments, other content locations of the display screen 134 of the display 132 may be used based on, for example, the location of the viewer relative to the display screen 134 or other criteria.

Referring back to FIG. 3, in some embodiments, the viewing angle determination module 202 may further extrapolate the remaining viewing angles as a function of the primary viewing angle determined in block 312 and each content location on the display screen 134 in block 314. For example, the viewing angle determination module 202 may have access to the physical dimensions of the display screen 134 of the display 132 or the dimensions of the computing device 100. Given a single, primary viewing angle and those dimensions, the viewing angle determination module 202 may be configured to calculate the viewing angle corresponding to each remaining content location. As such, in some embodiments the primary viewing angle determined in block 312 is used as the sole viewing angle from which to generate a content transformation as discussed below. Alternatively, in other embodiments, the primary viewing angle determined in block 312 is used to extrapolate other viewing angles without the necessity of determining the other viewing angles directly from the location of the viewer.

After one or more viewing angles are determined in block 308, the method 300 advances to block 316. In block 316, the content transformation module 204 generates a content transformation useable to apply a corrective distortion to the content, to improve the viewing perspective of the content when viewed at the one or more viewing angles. In some embodiments, the content transformation is embodied as a uniform transformation configured to uniformly transform the content regardless of the magnitude of the particular viewing angle. In such embodiments, the content transformation transforms the content as a function of the primary viewing angle determined in block 310, which approximates the other viewing angles. Alternatively, the content transformation module 204 may generate a non-uniform content transformation. That is, the content transformation module 204 may generate a unique content transformation for each viewing angle of the one or more viewing angles determined in block 310 or block 314.

As discussed above, the content transformation may be embodied as any type of transformation that may be applied to the content. In some embodiments, the content transformation may scale the content along an axis to thereby intentionally distort the content and improve the viewing perspective. For example, given a viewing angle $\alpha$ between the location of the viewer and a particular content location, the distortion of the content as seen by the viewer can be approximated as the sine of the viewing angle, that is, as $\sin(\alpha)$. Such perceived distortion may be corrected by stretching the content—that is, applying a corrective distortion—by an appropriate amount along the axis experiencing the perceived distortion. For example, considering a tablet computing device laying flat on a table, when viewed by a viewer from a seated position, the displayed content may appear distorted in the vertical content axis (e.g., along the visual axis of the viewer). For example, as shown in FIG. 4, a dashed line 408 may represent the vertical content axis that appears distorted to the viewer 402. As discussed above, the visual distortion at the center point 406 may be approximated as $\sin(\alpha)$. Assuming $\alpha$ is 45 degrees, the visual distortion is therefore approximately $\sin(45°)\approx 0.7$. Thus, the content at center point 406 appears to the viewer 402 to have a height roughly 70% of its actual height. By stretching the content along the vertical content axis, the distorted aspect of the content may be corrected or otherwise improved to generate a viewing perspective more akin to the viewing perspective achieved when viewing the tablet computing device perpendicular to the display screen. Referring back to FIG. 3, when applying a uniform content transformation, each content location is stretched by a uniform factor as a function of the primary viewing angle determined in block 310. More specifically, such factor may be calculated by dividing a length of the content along the vertical content axis by the sine of the primary viewing angle. Alternatively, when applying a non-uniform content transformation, each content location may be stretched by a unique factor as a function of the particular viewing angle associated with each content location (e.g., the unique factor may be equal to the sine of the corresponding viewing angle). In such embodiments, content locations further away from the viewer may be stretched more than content locations closer to the viewer. Of course, the stretching of the content may make content in some locations not visible on the display screen 134 of display 132. For example, a hypertext markup language web page (e.g., an HTML5 web page) or document content may flow off the bottom of the display screen due to the stretching transformation.

Alternatively, the content transformation may compress content an appropriate amount along an axis perpendicular to the axis experiencing the distortion (e.g., perpendicular to the viewing axis). For example, considering again the tablet computing device laying flat on a table and viewed from a seated position, displayed content may appear distorted in the vertical content axis, which distortion could be corrected by compressing the content horizontally. For example, as shown in FIG. 4, the dashed line 408 may represent the vertical axis experiencing the distortion, and a horizontal axis perpendicular to the vertical axis 408 used for correction is not shown. It should be appreciated that compressing the content allows all content to remain visible on the display screen 134 of the display 132 as no content need flow off the display screen. Referring back to FIG. 3, similar to the stretching transformation discussed above, each content location may be compressed by a uniform factor as a function of the primary viewing angle determined in block 310. More specifically, such factor may be calculated by multiplying a length of the content along the horizontal axis by the sine of the primary viewing angle. Alternatively, each content location may be compressed by a unique factor as a function of the particular viewing angle associated with each content location. More specifically, such factor may be calculated by multiplying a length of the content location along the horizontal axis by the sine of the particular viewing angle. In such embodiments, content locations further away from the viewer may be compressed more than content locations closer to the viewer.

Further, in embodiments in which the content is embodied as or includes text, the content transformation may modify the viewing perspective by increasing the vertical height of the rendered text. Such transformation may be appropriate for primarily textual content or for use on a computing device with limited graphical processing resources, for example, an e-reader device. For example, such transformation may be appropriate for content stored in a hypertext markup language format such as HTML5.

In some embodiments, the content transformation may transform content along more than one axis to improve the viewing perspective. For example, each content location may be scaled an appropriate amount along each axis (which may be orthogonal to each other in some embodiments) as a function of the viewing angle associated with each content location. Such content transformation is similar to the inverse of the well-known "keystone" perspective correction employed by typical visual projectors to improve viewing perspective when projecting onto a surface at an angle.

After the content transformation has been generated in block 316, the content rendering module 206 renders the content using the content transformation in block 318. For conventional display technologies, the content rendering module 206 may apply the content transformation to an in-memory representation of the content and then rasterize the content for display on the display screen of the display 132. Alternative embodiments may apply the content transformation by physically deforming the pixels and/or other display elements of the display screen 134 of the display 132 (e.g., in those embodiments in which the display screen 134 is deformable).

After the content is rendered, the method 300 loops back to block 302 in which the computing device 100 determines whether to automatically adjust rendering based on a content viewing angle(s) of a viewer. In this way, the perspective correction may continually adapt to changes in viewing angle through an iterative process (e.g., when the viewer or computing device move to a new, relative location).

Referring back to block 302, if the computing device 100 determines not to automatically adjust rendering based on viewing angle, the method 300 advances to block 320. In block 320, the computing device 100 determines whether to manually adjust rendering based on viewing angle. Such determination may be made in use, may be pre-configured (e.g., with a hardware or software switch), or may be dependent on whether the computing device 100 includes the viewing angle input 138. If the computing device 100 determines not to manually adjust rendering based on viewing angle, the method 300 advances to block 322, in which the computing device 100 displays content as normal (i.e., without viewing perspective correction).

If, in block 320, the computing device 100 does determine to manually adjust rendering based on the viewing angle, the method 300 advances to block 324. In block 324, the viewing angle determination module 202 receives viewing angle input data from the viewing angle input 138. As described above, the viewing angle input 138 may be embodied as a hardware or software user control, which allows the user to specify a viewing angle. For example, the viewing angle input 138 may be embodied as a hardware thumbwheel that the viewer rotates to select a viewing angle. Alternatively, the viewing angle input 138 may be embodied as a software slider that the viewer manipulates to select a viewing angle. In some embodiments, the viewing angle input 138 may include multiple controls allowing the viewer to select multiple viewing angles.

In block 326, the viewing angle determination module 202 determines one or more viewing angles based on the viewing angle input data. To do so, in block 328, the viewing angle determination module 202 may determine a viewing angle for each content location as a function of the viewing angle input data. For example, the viewing angle input data may include multiple viewing angles selected by the user using multiple viewing angle input controls 138. The determination of multiple viewing angles may be desirable for large, immovable computing devices usually viewed from the same location such as, for example, table-top computers or the like.

Alternatively, in block 330, the viewing angle determination module 202 may determine a primary viewing angle as a function of the viewing angle input data and a pre-defined content location on the display screen of the display 132. As discussed above, the pre-defined content area may be embodied as the center of the display screen 134 of the display 132 in some embodiments. Additionally, in some embodiments, the viewing angle input 138 may allow the viewer to directly manipulate the primary viewing angle. As discussed above, in those embodiments utilizing a uniform content transformation, only the primary viewing angle may be determined in block 326.

Further, in some embodiments, the viewing angle determination module 202 may extrapolate the remaining viewing angles as a function of the primary viewing angle determined in block 330 and each pre-defined content location on the display screen. For example, the viewing angle determination module 202 may have access to the physical dimensions of the display screen of the display 132 or the dimensions of the computing device 100. Given a single, primary viewing angle and those dimensions, the viewing angle determination module 202 may be able to calculate the viewing angle corresponding to each remaining content location.

After one or more viewing angles are determined in block 326, method 300 advances to block 316. As discussed above, the content transformation module 204 generates a content transformation useable to apply a corrective distortion to the content, to improve the viewing perspective of the content when viewed at the determined one or more viewing angles in block 316. After the content transformation has been generated in block 316, the content rendering module 206 renders the content using the content transformation in block 318 as discussed above. After the content is rendered, the method 300 loops back to block 302 in which the computing device 100 determines whether to automatically adjust rendering based on a content viewing angle(s) of a viewer.

EXAMPLES

Illustrative examples of the devices, systems, and methods disclosed herein are provided below. An embodiment of the devices, systems, and methods may include any one or more, and any combination of, the examples described below.

In one example, a computing device to improve viewing perspective of content displayed on the computing device may include a display having a display screen on which content can be displayed, a viewing angle determination module, a content transformation module, and a content rendering module. In an example, the viewing angle determination module may determine one or more viewing angles of the content relative to a viewer of the content. In an example, the content transformation module may generate a content transformation for each one or more viewing angles as a function of the corresponding one or more viewing angles, the content transformation usable to apply a corrective distortion to the content to improve the viewing perspective of the content when viewed at the one or more viewing angles. In an example, the content rendering module may render, on the display screen, content as a function of the content transformation. In an example, to render content as a function of the content transformation may include to render content represented in a hypertext markup language format selected from the group consisting of: HTML, XHTML, and HTML5.

In an example, to generate the content transformation as a function of the one or more viewing angles may include to generate a uniform content transformation as a function of a single viewing angle of the one or more viewing angles, and to render the content may include to render the content using the uniform content transformation.

Additionally, in an example, the computing device may include a viewer location sensor. In an example, to determine one or more viewing angles may include to determine a location of a primary viewer as a function of sensor signals received from the viewer location sensor, and to determine a primary viewing angle as a function of the determined location of the primary viewer and a pre-defined content location on the display screen of the display. Additionally, in an example, the computing device may include a viewing angle input controllable by a user of the computing device. In an example, to determine one or more viewing angles may include to receive viewing angle input data from the viewing angle input, and to determine a primary viewing angle as a function of the viewing angle input data and a pre-defined content location on the display screen of the display. Additionally, in an example the pre-defined content location may include a center point of the display screen of the display.

In an example, to render content as a function of the content transformation may include to stretch the content along a reference axis parallel to the display screen of the display as a function of the primary viewing angle. In an example, to stretch the content may include to scale the content by a stretch factor calculated by dividing a length of the content defined in the direction of the reference axis by a sine of the primary viewing angle. Additionally, in an example, to render the content as a function of the content transformation may include to compress the content along a reference axis parallel to the display screen of the display as a function of the primary viewing angle. In an example, to compress the content may include to scale the content by a compression factor calculated by multiplying a length of the content defined in the direction of the reference axis by a sine of the primary viewing angle. Additionally, in an example, to render the content as a function of the content transformation may include to increase a height property of text of the content as a function of the primary viewing angle.

Additionally, in an example, to generate the content transformation as a function of the one or more viewing angles may include to generate a unique content transformation for each viewing angle of the one or more viewing angles. In an example, to render the content may include to render the content using the unique content transformation corresponding to each viewing angle of the one or more viewing angles.

Additionally, in an example, the computing device may include a viewer location sensor. In an example, to determine one or more viewing angles may include (i) to determine a location of a primary viewer as a function of sensor signals received from the viewer location sensor, and (ii) to determine a viewing angle for one or more content locations on the display screen of the display as a function of the determined location of the primary viewer and a reference plane defined by the display screen of the display. In an example, each content location may include a single pixel of the display screen. Additionally, in an example, each content location may include a group of pixels of the display screen. Additionally, in an example, to determine one or more viewing angles further may include to determine the primary viewer from a plurality of viewers of the content.

Additionally, in an example, the computing device may include a viewing angle input controllable by a user of the computing device. In an example, to determine one or more viewing angles may include to receive viewing angle input data from the viewing angle input. In an example, to generate the content transformation may include to generate the content transformation as a function of the viewing angle input data.

Additionally, in an example, the computing device may include a viewer location sensor. In an example, to determine one or more viewing angles may include to determine a location of a primary viewer as a function of sensor signals received from the viewer location sensor, to determine a primary viewing angle as a function of the determined location of the primary viewer and a pre-defined content location on the display screen of the display, and to extrapolate a viewing angle for additional content locations on the display screen as a function of the primary viewing angle and each corresponding content location.

Additionally, in an example, the computing device may include a viewing angle input controllable by a user of the computing device. In an example, to determine one or more viewing angles may include to receive viewing angle input data from the viewing angle input, to determine a primary viewing angle as a function of the viewing angle input data and a pre-defined content location on the display screen of the display, and to extrapolate a viewing angle for additional content locations on the display screen as a function of the primary viewing angle and each corresponding content location.

In an example, to render content as a function of the content transformation may include to stretch the content along a reference axis parallel to the display screen of the display as a function of the one or more viewing angles. In an example, to stretch the content may include to scale the content at each content location on the display screen by a stretch factor calculated by dividing a length of the corresponding content location defined in the direction of the reference axis by a sine of the viewing angle corresponding to that content location. In an example, to stretch the content may include to deform each content location. In an example, the reference axis may be a height axis of the content. In an example, the reference axis may be a width axis of the content.

Additionally, in an example, to render content as a function of the content transformation may include to compress the content at each content location on the display screen along a reference axis parallel to the display screen of the display as a function of the corresponding content location and the viewing angle associated with the corresponding content location. In an example, to compress the content may include to scale the content at each content location on the display screen by a compression factor calculated by multiplying a length of the corresponding content location defined in the direction of the reference axis by a sine of the viewing angle corresponding to that content location. In an example, to compress the content may include to deform each content location.

Additionally, in an example, to render the content as a function of the content transformation may include to scale the content along a first axis parallel to the display screen of the display as a function of the content location on the display screen of the display and the viewing angle corresponding to the content location, and to scale the content along a second axis perpendicular to the first axis and parallel to the display screen of the display as a function of the content location on the display screen of the display and the viewing angle corresponding to the content location. Additionally, in an example, to render content as a function of the content transformation may include to perform an inverse keystone three-dimensional perspective correction on the content.

In another example, a method for improving viewing perspective of content displayed on a computing device may include determining, on the computing device, one or more viewing angles of the content relative to a viewer of the content; generating, on the computing device, a content transformation for each one or more viewing angles as a function of the corresponding one or more viewing angles, the content transformation usable to apply a corrective distortion to the content to improve the viewing perspective of the content when viewed at the one or more viewing angles; and rendering, on a display screen of a display of the computing device, content as a function of the content transformation. In an example, rendering content as a function of the content transformation may include rendering content represented in a hypertext markup language format selected from the group consisting of: HTML, XHTML, and HTML5.

In an example, generating the content transformation as a function of the one or more viewing angles may include generating a uniform content transformation as a function of a single viewing angle of the one or more viewing angles. In an example, rendering the content may include rendering the content using the uniform content transformation.

Additionally, in an example, determining one or more viewing angles may include determining, on the computing device, a location of a primary viewer as a function of sensor signals received from a viewer location sensor of the computing device; and determining, on the computing device, a primary viewing angle as a function of the determined location of the primary viewer and a pre-defined content location on the display screen of the display. Additionally, in an example, determining one or more viewing angles may include receiving, on the computing device, viewing angle input data from a viewing angle input of the computing device, the viewing angle input being controllable by a user of the computing device; and determining, on the computing device, a primary viewing angle as a function of the viewing angle input data and a pre-defined content location on the display screen of the display. Additionally, in an example, the pre-defined content location may include a center point of the display screen of the display.

In an example, rendering content as a function of the content transformation may include stretching the content along a reference axis parallel to the display screen of the display as a function of the primary viewing angle. In an example, stretching the content may include scaling the content by a stretch factor calculated by dividing a length of the content defined in the direction of the reference axis by a sine of the primary viewing angle. Additionally, in an example, rendering content as a function of the content transformation may include compressing the content along a reference axis parallel to the display screen of the display as a function of the primary viewing angle. In an example, compressing the content may include scaling the content by a compression factor calculated by multiplying a length of the content defined in the direction of the reference axis by a sine of the primary viewing angle. Additionally, in an example, rendering the content as a function of the content transformation may include increasing a height property of text of the content as a function of the primary viewing angle.

Additionally, in an example, generating the content transformation as a function of the one or more viewing angles may include generating a unique content transformation for each viewing angle of the one or more viewing angles. In an example, rendering the content may include rendering the content using the unique content transformation corresponding to each viewing angle of the one or more viewing angles.

Additionally, in an example, determining one or more viewing angles may include determining, on the computing device, a location of a primary viewer as a function of sensor signals received from a viewer location sensor of the computing device; and determining, on the computing device, a viewing angle for one or more content locations on the display screen of the display as a function of the determined location of the primary viewer and a reference plane defined by the display screen of the display. In an example, each content location may include a single pixel of the display screen. Additionally, in an example, each content location may include a group of pixels of the display screen. Additionally, in an example, determining one or more viewing angles further may include determining, on the computing device, the primary viewer from a plurality of viewers of the content.

Additionally, in an example, determining one or more viewing angles may include receiving, on the computing device, viewing angle input data from a viewing angle input of the computing device, the viewing angle input being controllable by a user of the computing device. In an example, generating the content transformation may include generating the content transformation as a function of the viewing angle input data.

Additionally, in an example, determining one or more viewing angles may include determining, on the computing device, a location of a primary viewer as a function of sensor signals received from a viewer location sensor of the computing device; determining, on the computing device, a primary viewing angle as a function of the determined location of the primary viewer and a pre-defined content location on the display screen of the display; and extrapolating, on the computing device, a viewing angle for additional content locations on the display screen as a function of the primary viewing angle and each corresponding content location.

Additionally, in an example, determining one or more viewing angles may include receiving, on the computing device, viewing angle input data from a viewing angle input of the computing device, the viewing angle input being controllable by a user of the computing device; determining, on the computing device, a primary viewing angle as a function of the viewing angle input data and a pre-defined content location on the display screen of the display; and extrapolating, on the computing device, a viewing angle for additional content locations on the display screen as a function of the primary viewing angle and each corresponding content location.

In an example, rendering content as a function of the content transformation may include stretching the content along a reference axis parallel to the display screen of the display as a function of the one or more viewing angles. In an example, stretching the content may include scaling the content at each content location on the display screen by a stretch factor calculated by dividing a length of the corresponding content location defined in the direction of the reference axis by a sine of the viewing angle corresponding to that content location. In an example, stretching the content may include deforming each content location. In an example, the reference axis may be a height axis of the content. In an example, the reference axis may be a width axis of the content.

Additionally, in an example, rendering content as a function of the content transformation may include compressing the content at each content location on the display screen along a reference axis parallel to the display screen of the display as a function of the corresponding content location and the viewing angle associated with the corresponding content location. In an example, compressing the content may include scaling the content at each content location on the display screen by a compression factor calculated by multiplying a length of the corresponding content location defined in the direction of the reference axis by a sine of the viewing angle corresponding to that content location. In an example, compressing the content may include deforming each content location.

Additionally, in an example, rendering content as a function of the content transformation may include scaling the content along a first axis parallel to the display screen of the display as a function of the content location on the display screen of the display and the viewing angle corresponding to the content location, and scaling the content along a second axis perpendicular to the first axis and parallel to the display screen of the display as a function of the content location on the display screen of the display and the viewing angle corresponding to the content location. Additionally, in an example, rendering content as a function of the content transformation may include performing an inverse keystone three-dimensional perspective correction on the content.

The invention claimed is:

1. A computing device to improve viewing perspective of content displayed on the computing device, the computing device comprising:

a display having a display screen on which content can be displayed;

a viewing angle determination module to determine one or more viewing angles of the content relative to a viewer of the content;

a content transformation module to generate a content transformation for each one or more viewing angles as a function of the corresponding one or more viewing angles, the content transformation to apply a corrective distortion to the content to generate transformed content, wherein the transformed content has an appearance, when viewed at the one or more viewing angles, that is similar to an appearance of the content when viewed perpendicular to the display; and a content rendering module to render, on the display screen, the transformed content as a function of the content transformation, wherein to render the transformed content as a function of the content transformation comprises to (i) render content represented in a hypertext markup language format selected from the group consisting of: HTML, XHTML, and HTML5; and (ii) increase a height property of text of the content as a function of the corresponding content location and the viewing angle associated with the corresponding content location.

2. The computing device of claim 1, further comprising a viewer location sensor, wherein to determine one or more viewing angles comprises to:

determine a location of a primary viewer as a function of sensor signals received from the viewer location sensor; and determine a viewing angle for one or more content locations on the display screen of the display as a function of the determined location of the primary viewer and a reference plane defined by the display screen of the display.

3. The computing device of claim 2, wherein:

to determine a viewing angle for one or more content locations on the display screen comprises to determine a primary viewing angle as a function of the determined location of the primary viewer and a pre-defined content location on the display screen of the display; and to generate a content transformation for each one or more viewing angles as a function of the corresponding one or more viewing angles comprises to generate a content transformation for each one or more viewing angles as a function of the primary viewing angle.

4. The computing device of claim 1, further comprising a viewing angle input controllable by a user of the computing device, wherein:

to determine one or more viewing angles comprises to receive viewing angle input data from the viewing angle input, and to generate the content transformation comprises to generate the content transformation as a function of the viewing angle input data.

5. The computing device of claim 4, wherein:

to determine one or more viewing angles comprises to determine a primary viewing angle as a function of the viewing angle input data and a pre-defined content location on the display screen of the display; and to generate a content transformation for each one or more viewing angles as a function of the corresponding one or more viewing angles comprises to generate a content transformation for each one or more viewing angles as a function of the primary viewing angle.

6. The computing device of claim 1, wherein to render the transformed content as a function of the content transformation comprises one of to stretch the content at each content location on the display screen along a reference axis parallel to the display screen of the display as a function of the corresponding content location and the viewing angle associated with the corresponding content location and to compress the content at each content location on the display screen along a reference axis parallel to the display screen of the display as a function of the corresponding content location and the viewing angle associated with the corresponding content location.

7. The computing device of claim 1, wherein to render the transformed content as a function of the content transformation comprises to:

scale the content along a first axis parallel to the display screen of the display as a function of the content location on the display screen of the display and the viewing angle corresponding to the content location, and scale the content along a second axis perpendicular to the first axis and parallel to the display screen of the display as a function of the content location on the display screen of the display and the viewing angle corresponding to the content location.

8. The computing device of claim 7, wherein to render the transformed content as a function of the content transformation comprises to perform an inverse keystone three-dimensional perspective correction on the content.

9. A method for improving viewing perspective of content displayed on a computing device, the method comprising:

determining, on the computing device, one or more viewing angles of the content relative to a viewer of the content;

generating, on the computing device, a content transformation for each one or more viewing angles as a function of the corresponding one or more viewing angles, the content transformation to apply a corrective distortion to the content to generate transformed content, wherein the transformed content has an appearance, when viewed at the one or more viewing angles, that is similar to an appearance of the content when viewed perpendicular to the display; and rendering, on a display screen of a display of the computing device, the transformed content as a function of the content transformation, wherein rendering the transformed content as a function of the content transformation comprises (i) rendering content represented in a hypertext markup language format selected from the group consisting of: HTML, XHTML, and HTML5; and (ii) increasing a height property of text of the content as a function of the corresponding content location and the viewing angle associated with the corresponding content location.

10. The method of claim 9, wherein determining one or more viewing angles comprises:

determining, on the computing device, a location of a primary viewer as a function of sensor signals received from a viewer location sensor of the computing device; and determining, on the computing device, a viewing angle for one or more content locations on the display screen of the display as a function of the determined location of the primary viewer and a reference plane defined by the display screen of the display.

11. The method of claim 10, wherein:

determining one or more viewing angles comprises determining, on the computing device, a primary viewing angle as a function of the determined location of the primary viewer and a pre-defined content location on the display screen of the display; and generating a content transformation for each one or more viewing angles as a function of the corresponding one or more viewing angles comprises generating a content transformation for each one or more viewing angles as a function of the primary viewing angle.

12. The method of claim 9, wherein:

determining one or more viewing angles comprises receiving, on the computing device, viewing angle input data from a viewing angle input of the computing device, the viewing angle input being controllable by a user of the computing device, and generating the content transformation comprises generating the content transformation as a function of the viewing angle input data.

13. The method of claim 12, wherein determining one or more viewing angles comprises determining, on the computing device, a primary viewing angle as a function of the viewing angle input data and a pre-defined content location on the display screen of the display; and generating a content transformation for each one or more viewing angles as a function of the corresponding one or more viewing angles comprises generating a content transformation for each one or more viewing angles as a function of the primary viewing angle.

14. The method of claim 9, wherein rendering the transformed content as a function of the content transformation comprises one of stretching the content along a reference axis parallel to the display screen of the display as a function of the corresponding content location and the viewing angle associated with the corresponding content location and compressing the content at each content location on the display screen along a reference axis parallel to the display screen of the display as a function of the corresponding content location and the viewing angle associated with the corresponding content location.

15. The method of claim 9, wherein rendering the transformed content as a function of the content transformation comprises:

scaling the content along a first axis parallel to the display screen of the display as a function of the content location on the display screen of the display and the viewing angle corresponding to the content location, and scaling the content along a second axis perpendicular to the first axis and parallel to the display screen of the display as a function of the content location on the display screen of the display and the viewing angle corresponding to the content location.

16. The method of claim 15, wherein rendering the transformed content as a function of the content transformation comprises performing an inverse keystone three-dimensional perspective correction on the content.

17. One or more non-transitory, machine-readable media comprising a plurality of instructions that in response to being executed result in a computing device:

determining one or more viewing angles of the content relative to a viewer of the content;

generating a content transformation for each one or more viewing angles as a function of the corresponding one or more viewing angles, the content transformation to apply a corrective distortion to the content to generate transformed content, wherein the transformed content has an appearance, when viewed at the one or more viewing angles, that is similar to an appearance of the content when viewed perpendicular to the display; and rendering, on a display screen of a display of the computing device, the transformed content as a function of the content transformation, wherein rendering the transformed content as a function of the content transformation comprises (i) rendering content represented in a hypertext markup language format selected from the group consisting of: HTML, XHTML, and HTML5; and (ii) increasing a height property of text of the content as a function of the corresponding content location and the viewing angle associated with the corresponding content location.

18. The machine-readable media of claim 17, wherein determining one or more viewing angles comprises:

determining a location of a primary viewer as a function of sensor signals received from a viewer location sensor of the computing device; and determining a viewing angle for one or more content locations on the display screen of the display as a function of the determined location of the primary viewer and a reference plane defined by the display screen of the display.

19. The machine-readable media of claim 18, wherein:

determining one or more viewing angles comprises determining a primary viewing angle as a function of the determined location of the primary viewer and a pre-defined content location on the display screen of the display; and generating a content transformation for each one or more viewing angles as a function of the corresponding one or more viewing angles comprises generating a content transformation for each one or more viewing angles as a function of the primary viewing angle.

20. The machine-readable media of claim 17, wherein:

determining one or more viewing angles comprises receiving viewing angle input data from a viewing angle input of the computing device, the viewing angle input being controllable by a user of the computing device, and generating the content transformation comprises generating the content transformation as a function of the viewing angle input data.

21. The machine-readable media of claim 20, wherein determining one or more viewing angles comprises determining a primary viewing angle as a function of the viewing angle input data and a pre-defined content location on the display screen of the display; and generating a content transformation for each one or more viewing angles as a function of the corresponding one or more viewing angles comprises generating a content transformation for each one or more viewing angles as a function of the primary viewing angle.

22. The machine-readable media of claim 17, wherein rendering the transformed content as a function of the content transformation comprises one of stretching the content along a reference axis parallel to the display screen of the display as a function of the corresponding content location and the viewing angle associated with the corresponding content location and compressing the content at each content location on the display screen along a reference axis parallel to the display screen of the display as a function of the corresponding content location and the viewing angle associated with the corresponding content location.

23. The machine-readable media of claim 17, wherein rendering the transformed content as a function of the content transformation comprises:

scaling the content along a first axis parallel to the display screen of the display as a function of the content location on the display screen of the display and the viewing angle corresponding to the content location, and scaling the content along a second axis perpendicular to the first axis and parallel to the display screen of the display as a function of the content location on the display screen of the display and the viewing angle corresponding to the content location.

24. The machine-readable media of claim 23, wherein rendering the transformed content as a function of the content transformation comprises performing an inverse keystone three-dimensional perspective correction on the content.

* * * * *